United States Patent [19]

Sedlmair

[11] 4,094,530

[45] June 13, 1978

[54] FRONT JAW FOR SAFETY SKI BINDINGS

[75] Inventor: Gerhard Sedlmair, Farchant, Germany

[73] Assignee: Hannes Marker, Germisch-Partenkirchen, Germany

[21] Appl. No.: 779,773

[22] Filed: Mar. 21, 1977

[30] Foreign Application Priority Data

Mar. 22, 1976 Germany ..... 2612069

[51] Int. Cl. ..... A63c 9/08

[52] U.S. Cl. ..... 280/625

[58] Field of Search ..... 280/625

[56] References Cited

U.S. PATENT DOCUMENTS 3,194,574 7/1965 Beyl ..... 280/625

3,900,207 8/1975 Iizuka ..... 280/625

3,993,327 11/1976 Kaineder ..... 280/625

*Primary Examiner*—Robert R. Song

*Attorney, Agent, or Firm*—Fleit & Jacobson

[57] ABSTRACT

A holder for the toe end of the sole of a ski boot comprises two jaws biassed by a spring to an operative position at which the jaws lie against a common abutment and together define a mouth for accommodating the toe end of the sole. The abutment is a nut engaged on a screw. The faces of the jaws that make contact with the abutment or the faces of the abutment making contact with the jaws are tapered so that, upon axial movement of the nut caused by turning the screw, the width of said mouth is adjusted.

7 Claims, 2 Drawing Figures

FRONT JAW FOR SAFETY SKI BINDINGS

The invention relates to a front jaw for a safety ski binding, comprising two levers which are pivotable about vertical shafts on a jaw portion that is fixed with respect to the ski and which in their normal position are influenced by a spring to engage a central abutment.

In known such jaws, the levers each carry a sole holder which can swivel freely about a vertical shaft. The sole holders are in the form of angular levers and are automatically adjustable within wide limits to the width of the sole when the boot is introduced in the ski binding.

Since a certain amount of standardisation of sole widths is taking place to an increasing extent in the case of ski boots, the expense involved in catering for boots having widely different sole widths is often no longer necessary.

The purpose of the present invention is therefore to construct a front jaw of the aforementioned kind so that, without the expense of known front jaws, it offers adequate adjustability for adapting to different sole widths of modern ski boots whilst meeting all the other conditions required for the safety function of such a front jaw. It is also important that use can be made easily of the possibility of adjustment, even when the boot is located in the binding.

According to the invention, a front jaw for a safety ski binding comprises two levers which are pivotable about vertical shafts on a jaw portion that is fixed with rspect to the ski and which in their normal position are influenced by a spring to engage a central abutment, wherein the free ends of the levers serve as retainers for the sole of a ski boot to restrain outward and upward movement thereof, the abutment is formed by a spacer member having a tapped hole engaging a screw which is rotatably mounted in the jaw but prevented from axial displacement, and an oblique plane is provided between the spacer member and each of the levers.

By turning the screw, the spacer member can be moved upwardly and downwardly so that the sole holders become more or less spread apart on account of the wedge action of the oblique planes and a wider or narrower mouth is defined for receiving the front end of the sole. The spacer member is prevented from turning together with the screw by reason of the resilient abutment of the sole holders against the spacer member.

Figure 2:
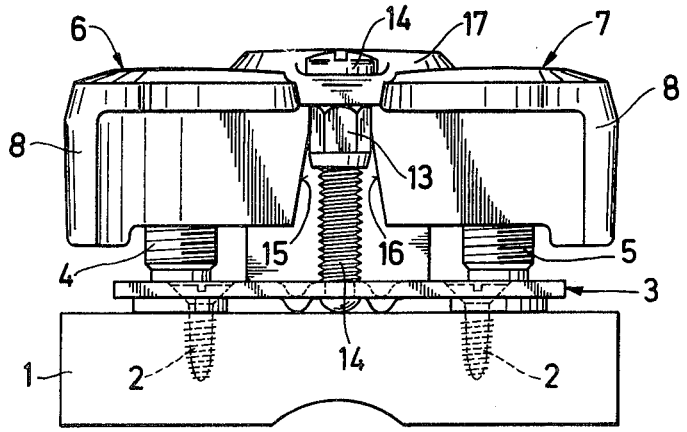
Figure 1:
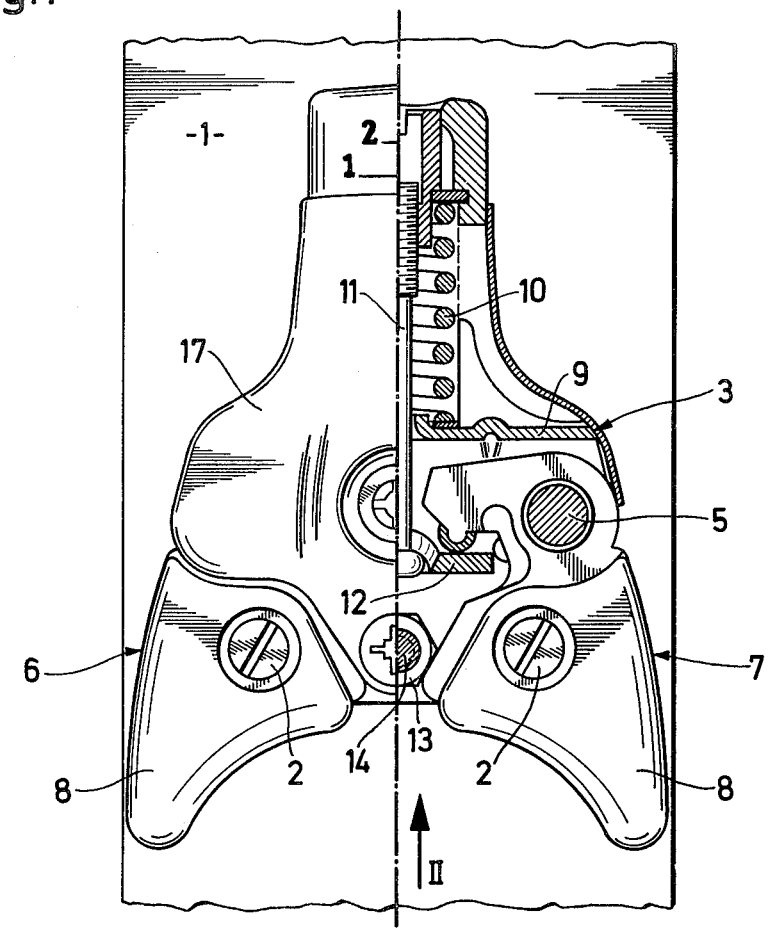

Other features of the invention will become evident from the following description of an example illustrated in the accompanying drawing, wherein:

FIG. 1 is a plan view of the front jaw in which the right-hand half of the jaw is shown cut open, and FIG. 2 is an elevation of the FIG. 1 jaw viewed from the sole holder end.

The illustrated front comprises a jaw portion 3 which is secured on a ski 1 by two screws 2 and which consist of a U-shaped bent piece of sheet metal. Two vertical shafts 4, 5 are provided in the two limbs of the jaw portion and each of these supports a pivotable lever 6 or 7. The outer free end of each lever serves as a holder 8 for the sole of a ski boot (not shown) to prevent outward and upward movement thereof.

A helical compression spring 10 is supported on the web 9 of the jaw portion 3. By way of a pin 11 passing through the web of the jaw portion and by way of a yoke 12, this spring acts on the inner free ends of the two-armed levers 6, 7 so that the latter are in their normal position held in abutment against a spacer member 13. This spacer member is provided with a tapped hole engaged by a screw 14. The screw 14 is parallel to the shafts 4, 5 and is rotatable in the jaw portion 3 but held against axial displacement. The faces 15, 16 of the levers abutting against the spacer member diverge downwardly (see FIG. 2).

By turning the screw 14, the spacer member 13 can be moved upwardly and downwardly so that the ends of the levers 6, 7 forming the sole holders 8 are spread more or less apart on account of the wedge effect of the oblique planes and define a wider or narrower mouth for receiving the front end of the sole of a ski boot.

In the position illustrated in FIG. 2, the spacer member 13 is in its upper limiting position. The sole holders 8 are spread apart by a maximum amount. If, now, a ski boot is introduced in the binding, the correct position of the sole holders can be readily set by appropriately screwing the spacing member further downwardly.

As will be evident from the left-hand half of FIG. 1, the jaw portion 3 carries a cap 17 covering the spring. To facilitate assembly of the front jaw, each sole holder contains an assembly hole for the respective mounting screw 2, as will be evident from FIG. 1.

The spacer member is a simple nut of which the abutment faces for the sole holders are mirror-image symmetrical.

In contrast with the illustrated construction, it is of course also possible for the faces of the sole holders that make contact with the spacer member to diverge upwardly. Further, the oblique planes could be provided on the spacer member itself, in which case the latter will have the shape of the frustum of a pyramid.

I claim:

1. A front jaw for a safety ski binding, comprising a jaw portion adapted to be fixed with respect to a ski and having two vertical shafts, a central abutment attached to the jaw portion, two levers pivotable about the vertical shafts, first ends of the levers serving as retainers for a sole of a ski boot to restrain outward and upward movement thereof, a vertical screw which is rotatably mounted in the jaw portion for engaging the tapped hole, the screw being prevented from axial displacement, the spacer member being vertically displaceable upon rotation of the screw, spring means for urging second ends of said levers into engagement with said spacer member, one of said spacer members and said second ends having an engagement surface formed as an oblique surface so that vertical movement of said spacer member varies the spacing between the first ends of said levers.

2. A front jaw according to claim 1, wherein the spacer member is a nut having two mirror-image symmetrical abutment faces engageable with the second ends of said levers.

3. A front jaw according to claim 1, wherein the spacer member has a frusto-pyramidal shape.

4. A front jaw according to claim 1, wherein the engagement surfaces of the second ends of said levers diverge downwardly.

5. A front jaw according to claim 4, wherein the spacer member is a nut having two mirror-image symmetrical abutment faces engageable with the second ends of said levers.

6. A front jaw according to claim 4, wherein the spacer member has a frusto-pyramidal shape.

7. A front jaw for a safety ski binding, comprising a jaw portion fixed with respect to a ski and having two vertical shafts, a central abutment attached to the jaw portion and having a vertically movable spacer member, two levers pivotable about the vertical shafts, first ends of the levers serving as retainers for a sole of a ski boot to restrain outward and upward movement thereof, means for vertically moving said spacer member, spring means for urging second ends of said levers into engagement with said spacer member, one of said spacer members and said second ends having an engagement surface formed as an oblique surface so that vertical movement of said spacer member varies the spacing between the first ends of said levers.

* * * * *